US005221197A

United States Patent [19]

Kochnev et al.

[11] Patent Number: 5,221,197

[45] Date of Patent: Jun. 22, 1993

[54] WORKING MEMBER OF A HELICAL DOWNHOLE MOTOR FOR DRILLING WELLS

[76] Inventors: Anatoly M. Kochnev, prospekt Dekabristov, 16, kv. 46; Andrei N. Vshivkov, ulitsa Pushkina, 11, kv. 131; Vladimir B. Goldobin, ulitsa K. Pozharskogo, 11, kv. 133, all of Perm, U.S.S.R.

[21] Appl. No.: 741,430

[22] PCT Filed: Dec. 8, 1989

[86] PCT No.: PCT/SU89/00309

§ 371 Date: Aug. 8, 1991

§ 102(e) Date: Aug. 8, 1991

[87] PCT Pub. No.: WO91/09201

PCT Pub. Date: Jun. 27, 1991

[51] Int. Cl.[5] ..... F01C 1/107

[52] U.S. Cl. ..... 418/48; 418/178; 29/888.023

[58] Field of Search ..... 418/48, 153, 178; 175/107; 29/888.023

[56] References Cited

U.S. PATENT DOCUMENTS

| | | | |
|---|---|---|---|
| 3,499,389 | 3/1970 | Seeberger et al. | 418/48 |
| 3,912,426 | 10/1975 | Tschirky | 418/48 |
| 4,140,444 | 2/1979 | Allen | 418/48 |
| 4,415,316 | 11/1983 | Jurgens | 418/48 |

FOREIGN PATENT DOCUMENTS

| | | | |
|---|---|---|---|
| 1488652 | 6/1967 | France | 418/48 |
| 2349729 | 11/1977 | France . | |

*Primary Examiner*—John J. Vrablik

*Attorney, Agent, or Firm*—Keck, Mahin & Cate

[57] ABSTRACT

A working member of a helical downhole motor can have the form of either a rotor with outer helical teeth or a stator with inner helical teeth. The working member includes separate sections having helical teeth arranged in succession, one after another, and interconnected by rings. Each ring has helical teeth coinciding in pitch and direction with the helical teeth of the sections, and equidistant in profile. This allows automatic orientation of the helical teeth of the sections of the working member.

3 Claims, 3 Drawing Sheets

WORKING MEMBER OF A HELICAL DOWNHOLE MOTOR FOR DRILLING WELLS

TECHNICAL FIELD

This invention relates generally to drilling equipment and, more particularly, to a working member of downhole motors for drilling oil and gas wells. The working member of a helical downhole motor can be either a rotor or a stator having helical teeth operating in conjunction, and normally is known as a working pair of the motor.

PRIOR ART

There is known a working member of a helical downhole motor in the form of a rotor, or a stator with the rotor having one or more teeth, and the stator having two or more teeth. In each working pair, the numbers of teeth in the stator and rotor differ by one.

As a rule, the know downhole motors have metal one-piece rotors of solid or tubular construction. The stators are normally rubber-metal with inner helical teeth on an elastomeric lining connected by vulcanization with a cylindrical bore of the metal body of the stator. The number of pitches of helical teeth in a working pair of the known motors is generally somewhat more than two. Provision of a greater number of pitches of helical teeth in the working pair is associated with technical difficulties. However, an increase in the number of pitches is necessitated by an increase in the moment of force at the output shaft influencing the drilling performance. There is a trend to increase the number of pitches in the working pair through providing a working member made up of separate interconnected sections.

There is known a multipitch working member of a helical downhole motor in the form of a rotor or a stator (cf., U.S. Pat. No. 3,912,426). The rotor includes separate sections with outer helical teeth arranged in succession, one after another, and rigidly interconnected by welding. The stator also includes separate sections with inner helical teeth, and a means for joining the sections. This means has the form of holes at one end of the adjacent sections and pins at the other end. End sections of the stator are clamped in the casing by a threaded connection.

However, this construction of the means for joining the sections of the working member necessitates very accurate orientation of the working helical surfaces of the rotor whose sections are interconnected by welding, and also necessitates mechanical working of the welded seam between the sections, which is especially difficult for multiple rotors having a number of teeth greater than one, and intricate cross section. When using a stator as the working member, reliability of the joint between the sections is affected, because the moment of force is transmitted between the sections through the pins of relatively small diameter determined by the cross section of the motor and height of the stator tooth. This disadvantage is especially pronounced in multilobe stators characterized by a high moment of force.

French patent No. 2,349,729 teaches a working member of a helical downhole motor for drilling wells, such as a rotor, made up of separate sections with outer helical teeth arranged in succession one after another, and joined by a connecting means. This means for joining the sections includes a rod element onto which the rotor sections are successively mounted. End faces of the rotor sections have holes to receive pins connecting the sections. Several rotor sections arranged in succession on the rod are secured at the ends by a threaded connection. The rotor of this construction accommodates, at the rod, rotor sections of different lengths which are easy to manufacture. The length of each such section can vary from 15 to 30 cm.

The working member of this helical downhole motor acting as a stator or as a rotor includes separate sections arranged in succession one after another. The ends of the stator sections have holes receiving pins to join the sections, whereas the ends of the stator sections are secured in a casing by means of a threaded connection.

However, in this working member of a helical downhole motor, the sections are not sufficiently reliably interconnected, as the moment of force is transmitted between the sections of the working member (rotor or stator) through the pins in number not exceeding the number of teeth of the working member, whereas the diameter of the pins is limited by the cross section of the rotor or stator and the height of their teeth.

Orientation of the helical surfaces of the connectable sections of such a working member requires high accuracy of registering the holes with the pins, positioning the holes relative to the fitting surfaces of the sections at a rod of the rotor, or at a casing of the stator, and arranging them relative to the helical teeth of the rotor or stator in the plane of end faces of each working member. Any deviations in mutual positioning of these elements lead to less accurate orientation, or failure to assemble the rotor or stator.

SUMMARY OF THE INVENTION

The present invention aims at providing a working member of a helical downhole motor for drilling wells with connecting elements of the sections of this working member so constructed as to reliably join the sections of the working member to transmit substantial moments of force without overcomplicating the manufacture of such sections or joining the sections into the working member.

The aim of the invention is attained by a working member of a helical downhole motor for drilling wells comprising separate tubular sections having helical teeth arranged in succession and joined by connecting elements. According to the invention, each connecting element has the form of a ring rigidly secured at the connectable sections and having helical teeth of a pitch and direction equal to the pitch and direction of the helical teeth of the connectable sections, whereas the profile of the helical teeth of the ring is equidistant to the profile of the helical teeth of the connectable sections.

Preferably, each ring has a wall of continuous or variable thickness.

Thanks to the rings connecting the sections of the working member having helical teeth of a pitch and direction equal to those of the helical teeth of the sections, whereas the profile of the helical teeth of the rings is equidistant to the profile of the teeth of the sections, the moment of force is transmitted through the mating toothed helical surfaces engaging with each other through the entire contour of their lateral and axial sections. As a result, the large area of engagement between the mating helical surfaces of the sections of the working member and rings connecting the sections ensures low stresses in the joint, and consequently high reliability of the connection.

Equidistant profiles of the helical teeth of the sections of the working member and rings having the same pitch and direction of their helical teeth allow accurate automatic orientation of the helical teeth of the sections and continuity of their helical surfaces at joints between the sections.

Provision of the connecting element in the form of a ring with a wall of continuous thickness makes it possible to reduce the mass of the working member and simplify the manufacturing process.

When using one or several rings of the working member, such as a rotor, with a wall of variable thickness, the ring can be provided with a connecting element for linking the rotor with a cardan shaft or a flexible shaft through which the moment of force is transmitted from the rotor to the output shaft of the bearing unit of the downhole motor.

In addition, the rings having a wall of variable thickness are intended to connect the sections lengthwise of the working member, viz. rotor, and ensure reliable transmission of the moment of force at thinner walls of the working member.

BRIEF DESCRIPTION OF THE DRAWINGS

The invention will now be described in greater detail with reference to specific embodiments thereof taken in conjunction with the accompanying drawings, in which.

PREFERRED EMBODIMENTS OF THE INVENTION

Figure 1:
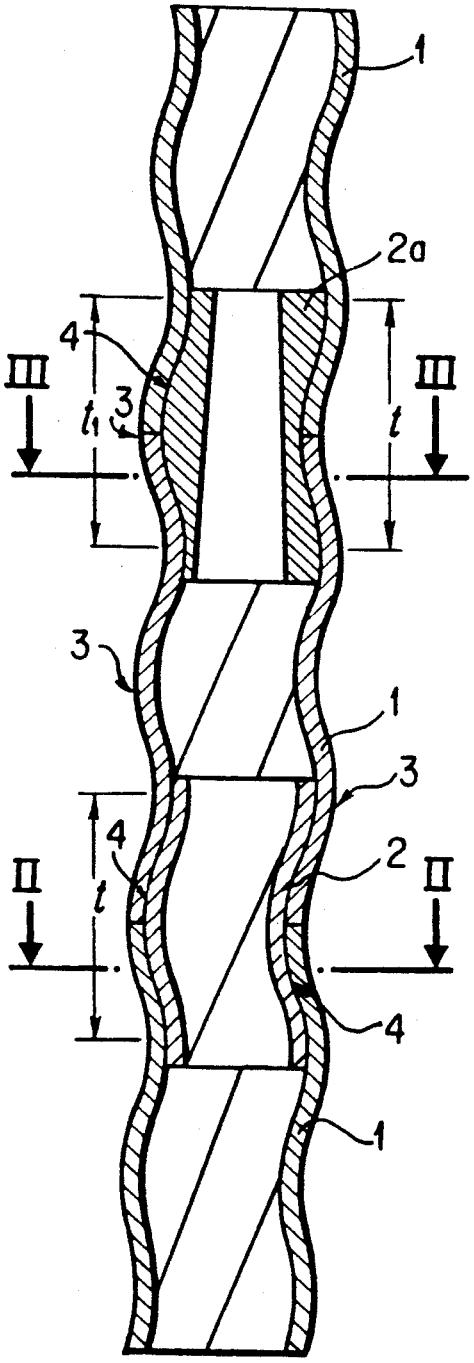
FIG. 1 is a longitudinal sectional view of a working member, for example a rotor, of a helical downhole motor for drilling wells provided with outer helical teeth.

The working member of a helical downhole motor with helical teeth, such as a rotor, is made up of separate tubular sections 1 (FIG. 1) arranged in succession one after another and interconnected by connecting element in the form of rings 2 and/or 2*a*.

Figure 3:
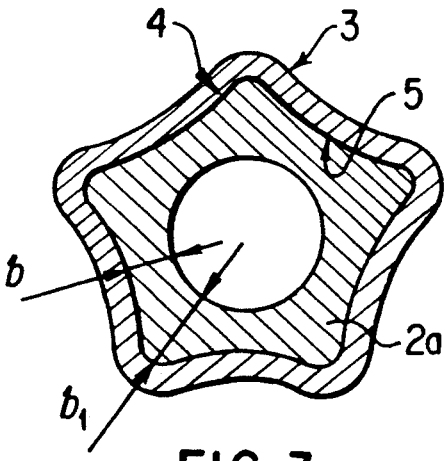
FIG. 3 is an enlarged section taken along the line III—III in FIG. 1.

The sections 1 of the working member have the form of a tubular shell with a wall of continuous thickness, teeth 3 thereof functioning as the working surfaces of the sections. Each ring element 2 or 2*a* is disposed inside the connectable sections overlapping the ends of these sections, and has outer helical teeth 4 coinciding in pitch t and direction with the pitch $t_1$ and direction of the teeth 32 of the sections 1 of the working member. The profile of the teeth 4 of the ring element 2 or 2*a* is equidistant with the shape of the teeth 3 of the connectable sections 1. As a result, the teeth 4 of the ring element 2 or 2*a* tightly fit the inner helical surface 5 (FIGS. 2,3) of the teeth 3 of the two adjacent sections 1. In order to ensure pressure-tightness and inseparability of the connection, the ring element 2 and/or 2*a* are rigidly secured at the sections 7 by being connected thereto in any known suitable manner, such as by soldering, welding, gluing, or the like.

Figure 2:
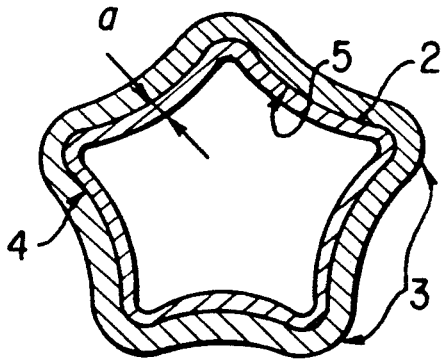
FIG. 2 is an enlarged section taken along the line II—II in FIG. 1.

The ring element 2 has the form of a hollow part with outer teeth 4 and, as seen best in FIG. 2, has a wall of continuous thickness a. The ring element 2*a* also has the form of a hollow part with outer teeth 4 and as seen best in FIG. 3, has a wall of varying thickness b, b. The length of the ring element 2 or 2*a* is 8 to 20 times smaller than the lengths of the connectable sections 1.

The ring element 2*a* has a wall of variable thickness. This element 2*a* can be used not only for connecting the sections 1, but also for connecting to the working member (rotor) of a cardan shaft, or a flexible shaft transmitting a moment of force and axial load from the rotor to the shaft of a bearing unit of the helical downhole motor (the cardan shaft and bearing unit not being shown).

Figure 4:
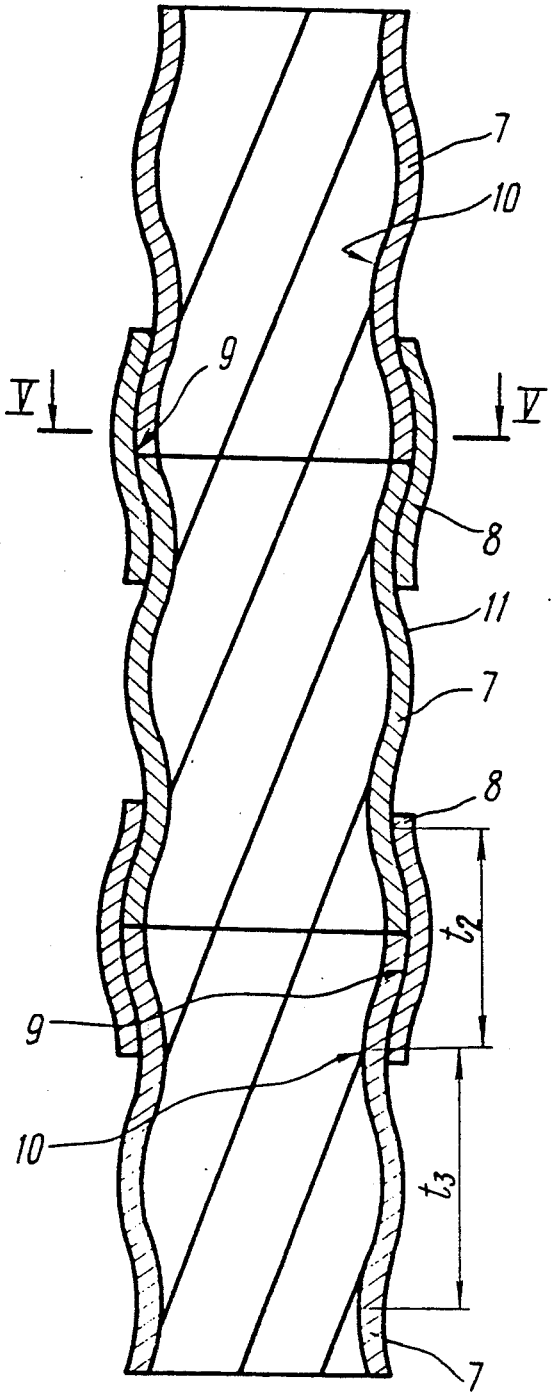
FIG. 4 is a longitudinal sectional view of a working member, for example a stator, of a helical downhole motor for drilling wells provided with inner helical teeth.
Figure 5:
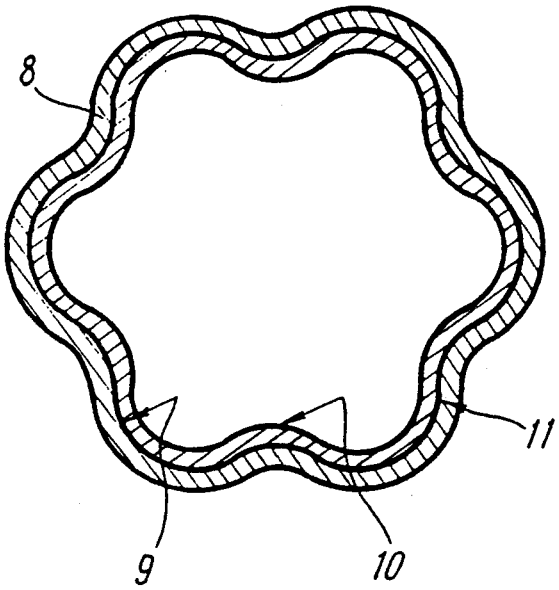
FIG. 5 is an enlarged section taken along the line V—V in FIG. 4.

The proposed connecting rings can be used for connecting the sections of the working member of helical downhole motor, particularly a stator, as best seen in FIGS. 4 and 5.

In this case, sections 7 of the working member are arranged in succession one after another. The sections 7 have the form of a shaped tubular shell with a wall of continuous thickness, and are connected by ring elements 8 outside the connectable sections 7 have the continuous wall thickness.

Each ring element 8 has inner helical teeth 9 coinciding in pitch $t_2$ and direction with the pitch $t_3$ and direction of inner teeth 10 of the sections 7 of the working member.

The profile of the inner helical teeth 9 of the ring elements 8 is equidistant to the shape of the inner teeth 10 of the connectable sections 7 of the working member. As a result, the teeth 9 of the ring elements 8 tightly fit to the outer helical surfaces 11 of the two adjacent sections 7, and are fixedly attached thereto in any known suitable manner.

Free portions of the end sections 7 of the working member, viz., stator, are connected to a string of drill pipes and to a bearing assembly (not shown in FIG. 4).

As helical downhole motors operate in the abrasive medium of drilling mud, one element of the working pair preferably has an elastomeric coating, such as nitrile rubber, or any other material suitable to increase resistance to wear.

Figure 6:
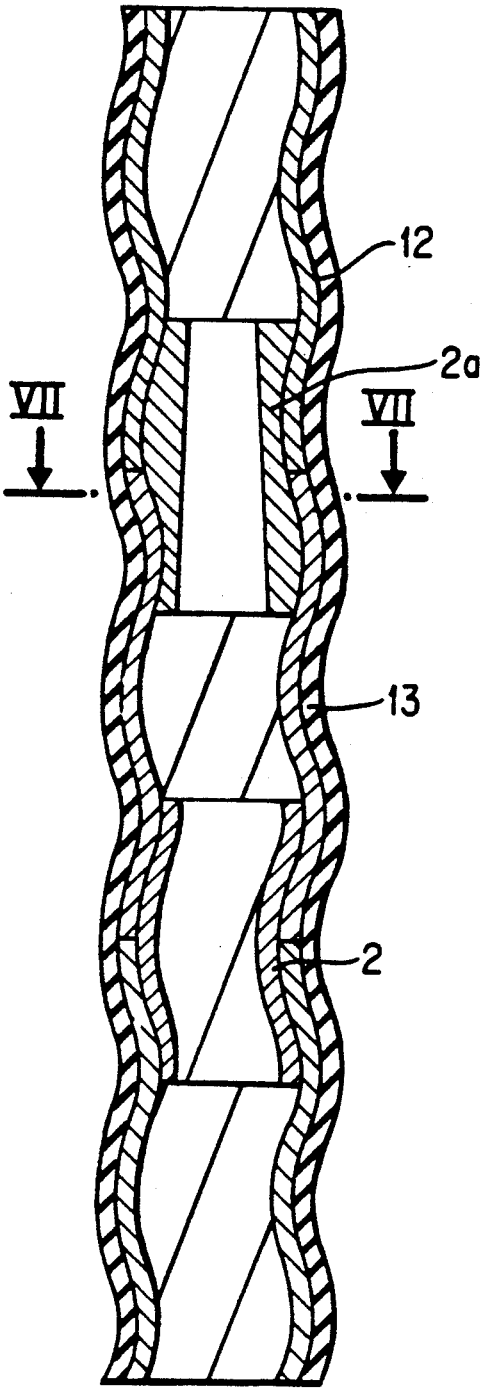
FIG. 6 is a longitudinal sectional view of the working member shown in FIG. 1 with a coating applied to the outer surface of the working member.
Figure 7:
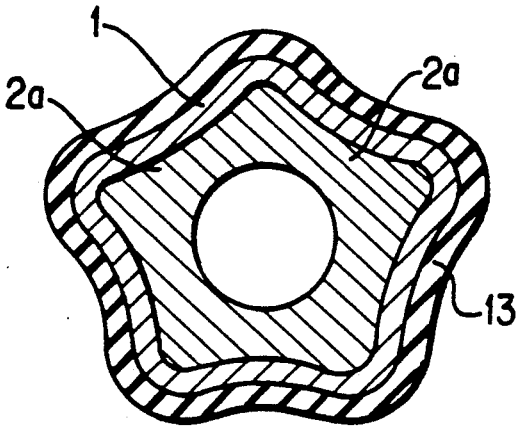
FIG. 7 is an enlarged section taken along the line VII—VIII in FIG. 6.

FIGS. 6 and 7 show a working member in the form of a rotor with outer helical teeth 12 thereof having a coating 13 applied thereto in any known suitable manner. Such a rotor can be used with a stator, also shown in FIG. 4. It is obvious that the coating can be applied to the inner surface of the helical teeth of the stator which, in this case, can be used with a rotor shown in FIG. 1.

A working member of a helical downhole motor made up of several tubular sections interconnected by ring elements can have any desired length.

When assembling the working member, such as a rotor, the tubular sections 1 are joined with the ring element 2 and/or the ring element 2*a* along helical toothed surfaces, and are secured to the element 2 and/or 2*a* in any known suitable fashion (such as by soldering, welding, or gluing) ensuring inseparability and pressure-tightness of the connection.

The working member assembled in this manner is used as a working pair in a helical downhole motor, and operates as follows.

As a washing fluid is fed to the interior of the working pair, viz. rotor made up of sections 1 (FIG. 1), unbalanced pressure forces of this fluid act to rotate this rotor for its outer teeth to roll on the inner teeth 10 (FIG. 4) of the mating working member, viz. stator made up of sections 7. The tubular working member can be made up of separate sections interconnected by ring element 2 by ring elements 2*a*, or by ring elements 8 and operates as a one-piece structure.

Provision of the ring elements 2, 2*a* or 8 with helical teeth 4 or 9 having a mass substantially smaller than the mass of the section 1 does not result in an increase in vibrations of the working member and ensures its operability under high loads. A moment of force at the sections 1 of the rotor is transmitted to an output shaft of the bearing unit of the helical downhole motor through a pivotable connection or a flexible shaft (the bearing unit of the motor and other parts and elements are not shown).

In view of the aforedescribed, the proposed construction of the working member of a helical downhole motor allows on increase in the number of pitches of the working pair through interconnection of separate stators or rotors by the proposed ring elements, and increase the moment of force at the output shaft.

The ring elements ensure automatic orientation of one section relative to the other, provide pressure tightness at the joint, reduce specific pressure in the working pair, and improve reliability. Another advantage is a higher resistance of the teeth of the stator to flexure. The quantity of a costly corrosion-resistant steel for fabricating the working member is reduced. In addition, the sue of tubular sections of the working member interconnected by a hollow ring element makes it possible to substantially reduce the dynamics of lateral oscillations of the motor excessive wear of the working member associated therewith.

Industrial Applicability

The helical downhole motor with the proposed construction arrangement of the working member is used from drilling oil and gas wells. The working member of the helical downhole motor can be either a stator or a rotor having helical teeth.

We claim:

1. A working member of a helical downhole motor for drilling wells comprising:

separate tubular sections having helical teeth arranged in succession and interconnected by connecting elements, each connecting element having the form of a ring, rigidly secured at the tubular sections and having helical teeth of a pitch and a direction equal to a pitch and a direction, respectively, of the helical teeth of the tubular sections, whereas a profile of the helical teeth of the ring is equidistant to a profile of the helical teeth of the sections.

2. A working member as claimed in claim 1, characterized in that each ring has a wall of continuous thickness.

3. A working member as claimed in claim 1, characterized in that each ring has a wall of variable thickness.

* * * * *